US009423203B2

(12) United States Patent
Simonds

(10) Patent No.: US 9,423,203 B2
(45) Date of Patent: Aug. 23, 2016

(54) CROSSBOW COCKING DEVICE

(71) Applicant: MCP IP, LLC, Sparta, WI (US)

(72) Inventor: Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/022,966

(22) Filed: Sep. 10, 2013

(65) Prior Publication Data

US 2014/0069403 A1 Mar. 13, 2014

Related U.S. Application Data

(60) Provisional application No. 61/699,248, filed on Sep. 10, 2012.

(51) Int. Cl.
*F41B 5/12* (2006.01)
*F41B 5/18* (2006.01)
*F41B 5/14* (2006.01)

(52) U.S. Cl.
CPC . *F41B 5/12* (2013.01); *F41B 5/123* (2013.01); *F41B 5/1469* (2013.01)

(58) Field of Classification Search
CPC ..... F41B 5/1469; F41B 5/12; F41B 5/123
USPC ..... 124/25, 86, 88, 90
See application file for complete search history.

(56) References Cited

U.S. PATENT DOCUMENTS 577,641 A 2/1897 Bruder
2,500,509 A * 3/1950 Bailey ..... F41B 5/12 124/25
2,609,810 A 9/1952 Gruner
3,670,711 A * 6/1972 Firestone ..... F41B 5/12 124/25
4,294,222 A * 10/1981 Pelsue ..... 124/25
D283,637 S 4/1986 Williams
4,587,944 A 5/1986 Barnett
4,649,891 A 3/1987 Bozek
4,649,892 A * 3/1987 Bozek ..... F41B 5/10 124/25
4,662,345 A * 5/1987 Stephens ..... F41A 9/70 124/25
4,693,228 A 9/1987 Simonds et al.
4,719,897 A * 1/1988 Gaudreau ..... F41B 5/1469 124/25
4,722,318 A 2/1988 Yankey
H000486 H 7/1988 Savioli
4,879,987 A 11/1989 Nishioka
4,942,861 A * 7/1990 Bozek ..... F41B 5/12 124/25
5,115,795 A * 5/1992 Farris ..... F41B 5/1469 124/25
5,243,956 A * 9/1993 Luehring ..... F41B 5/12 124/25
6,095,128 A * 8/2000 Bednar ..... F41B 5/123 124/25
6,286,496 B1 * 9/2001 Bednar ..... F41B 5/1469 124/25
6,560,911 B2 5/2003 Sharp
(Continued)

*Primary Examiner* — Alexander Niconovich

(57) ABSTRACT

In some embodiments, a crossbow system comprises a crossbow comprising a stock and a bow portion. The bow portion comprises a bowstring having a nocking point. The crossbow defines a shooting axis. The stock comprises a rope anchor located below the shooting axis. The crossbow system further comprises a cocking rope constructed and arranged to engage the bowstring and to be anchored to the rope anchor.

19 Claims, 7 Drawing Sheets

(56) References Cited

U.S. PATENT DOCUMENTS 6,651,641 B1 11/2003 Bower et al.
6,705,304 B1 * 3/2004 Pauluhn ..... F41B 5/12 124/25
6,799,566 B1 * 10/2004 Malucelli ..... F41B 5/12 124/25
6,874,491 B2 * 4/2005 Bednar ..... F41B 5/10 124/25
6,913,007 B2 * 7/2005 Bednar ..... F41B 5/1469 124/25
7,066,166 B2 * 6/2006 Crites, Jr. ..... F41B 5/1469 124/25
7,100,590 B2 * 9/2006 Chang ..... F41B 5/1469 124/25
7,174,884 B2 2/2007 Kempf et al.
7,328,693 B2 2/2008 Kempf
7,363,921 B2 4/2008 Kempf
7,624,725 B1 * 12/2009 Choma ..... F41B 5/1469 124/25
7,708,001 B2 5/2010 Kempf
7,753,041 B2 * 7/2010 Ogawa ..... F41B 5/12 124/25
7,784,453 B1 * 8/2010 Yehle ..... F41B 5/12 124/25
7,832,386 B2 11/2010 Bednar et al.
7,836,871 B2 * 11/2010 Kempf ..... F41B 5/123 124/25
7,930,849 B2 * 4/2011 Abraham et al. ..... 42/73
8,042,530 B2 * 10/2011 Barnett ..... F41B 5/12 124/23.1
8,312,869 B2 * 11/2012 Gillet ..... A01K 81/00 124/20.3
8,375,928 B1 * 2/2013 Bednar ..... F41B 5/1469 124/25
8,439,024 B2 * 5/2013 Barnett ..... F41B 5/1469 124/25
8,443,790 B2 * 5/2013 Pestrue ..... F41B 5/12 124/25
8,453,631 B1 * 6/2013 Kronengold ..... F41A 11/02 124/25
8,499,753 B2 * 8/2013 Bednar ..... F41B 5/123 124/25
8,573,192 B2 * 11/2013 Bednar ..... F41B 5/1469 124/25
8,689,774 B1 * 4/2014 Ritz ..... F41B 5/1469 124/25
9,022,013 B2 * 5/2015 Trpkovski ..... F41B 5/10 124/25
2002/0020403 A1 2/2002 Troubridge
2005/0022799 A1 * 2/2005 Bednar ..... F41B 5/10 124/25
2005/0076894 A1 * 4/2005 Crites, Jr. ..... F41B 5/1469 124/25
2005/0279338 A1 12/2005 Dziekan
2006/0086346 A1 * 4/2006 Middleton ..... F41B 5/12 124/25
2007/0101631 A1 5/2007 Bentley
2007/0289190 A1 12/2007 Oz
2008/0168969 A1 7/2008 Kempf
2009/0194086 A1 8/2009 Kempf
2009/0277435 A1 * 11/2009 Pestrue ..... F41B 5/1469 124/25
2010/0116259 A1 5/2010 Popov et al.
2010/0186728 A1 7/2010 Bednar et al.
2010/0269807 A1 * 10/2010 Kempf ..... F41B 5/12 124/25
2011/0016764 A1 1/2011 Cales
2011/0203561 A1 8/2011 Shaffer et al.
2011/0232619 A1 * 9/2011 Bednar ..... F41B 5/1469 124/86
2012/0037139 A1 * 2/2012 Barnett ..... F41B 5/1469 124/86
2012/0298087 A1 * 11/2012 Trpkovski ..... F41B 5/10 124/25

* cited by examiner

CROSSBOW COCKING DEVICE

CROSS-REFERENCE TO RELATED APPLICATIONS

This application claims the benefit of U.S. Provisional Patent Application No. 61/699,248, filed Sep. 10, 2012, the entire disclosure of which is hereby incorporated herein by reference.

BACKGROUND OF THE INVENTION

This invention relates generally to crossbows and more specifically to cocking methods and devices, and crossbow structures arranged to be used with cocking mechanisms.

Crossbows are generally known in the art. Crossbows typically include a bow assembly portion mounted on a stock portion, which typically includes a string latch and trigger assembly for holding a drawn crossbow string and selectively releasing it.

Crossbows can have high draw weights, and devices exist in the art to assist with cocking a crossbow. Such devices have included levers such as those taught in U.S. Pat. Nos. 3,670,711 and 4,719,897, or windlasses or built-in mechanical pulley or gear systems that have been attached to or built into the crossbow. Examples can be found in the following patents: U.S. Pat. No. 6,095,128, 6,286,496, 6,913,007, 7,100,590, 8,104,461 as well as U.S. Pat. Nos. 5,220,906, 6,799,566, 7,784,453, 7,810,480. All of the aforementioned patents teach cocking devices that are much more complex in concept and operation than is the relatively simple rope cocking devices as taught in the following prior art patents, U.S. Pat. No. 5,243,956 issued to Elmer Luehring, and U.S. Pat. No. 7,624,725 issued to David Choma.

Prior art rope cocking devices have been anchored to the crossbow either in-line with or above the arrow/bolt axis.

Crossbows have been reduced in size over the years, and a smaller overall length of a crossbow can result in a user leaning farther over the crossbow than before, for example leaning above the arrow/bolt axis. When the rope cocking anchor is at or above the arrow axis, and the user applied forces include a component directed above the arrow axis, the resulting forces can cause the bowstring to lift out of the desired shooting plane. Typically in such a situation, the cocking operation is aborted.

There remains a need for novel crossbow cocking methods and structures that provide for better crossbow cocking operations.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, a crossbow system comprises a crossbow comprising a stock and a bow portion. The bow portion comprises a bowstring having a nocking point. The crossbow defines a shooting axis. The stock comprises a rope anchor located below the shooting axis. The crossbow system further comprises a cocking rope constructed and arranged to engage the bowstring and to be anchored to the rope anchor.

In some embodiments, the rope anchor is attached to an underside of said stock. In some embodiments, the rope anchor comprises a groove that faces a rearward direction of said crossbow.

In some embodiments, a reference line extending between the rope anchor and the nocking point in a rest condition of said crossbow forms an angle with said shooting axis of at least 4 degrees. In some embodiments, the angle is approximately 6 degrees.

In some embodiments, the crossbow comprises a shoulder pad and the rope anchor is located on the shoulder pad.

In some embodiments, the crossbow comprises a second rope anchor. In some embodiments, a second rope anchor is located below a first rope anchor, and forms a larger angle with the shooting axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
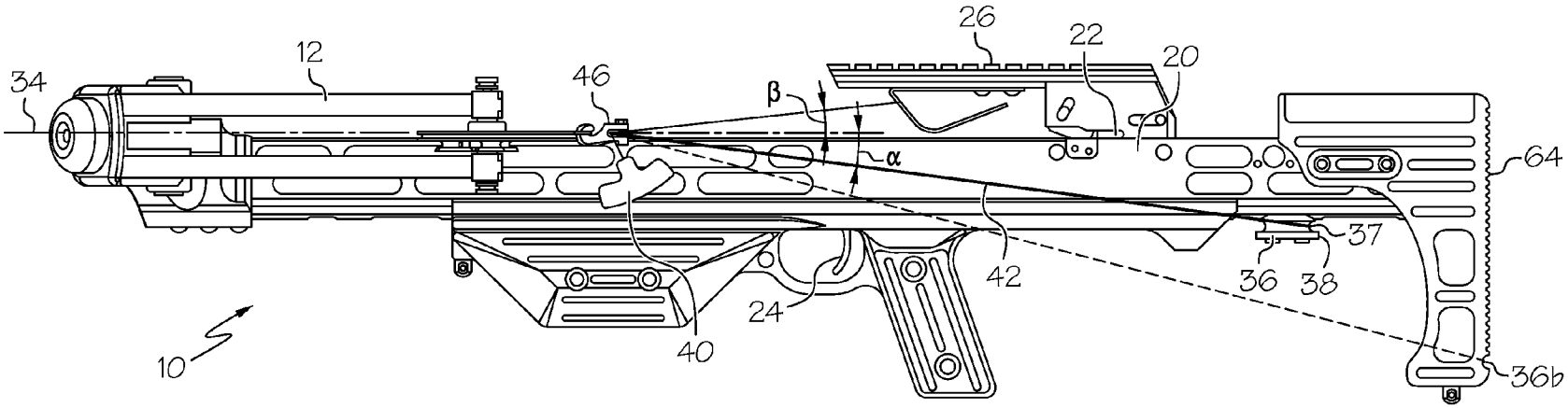
FIG. 1 shows a side view of an embodiment of a crossbow and a rope cocking device.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated. When terms such as "horizontal" and "vertical" are used herein (e.g. terms that require a reference coordinate system), the crossbow is referred to as if oriented in a standard shooting configuration. For example, as shown in FIG. 1, an axis of arrow flight would be considered horizontal.

Figure 2:
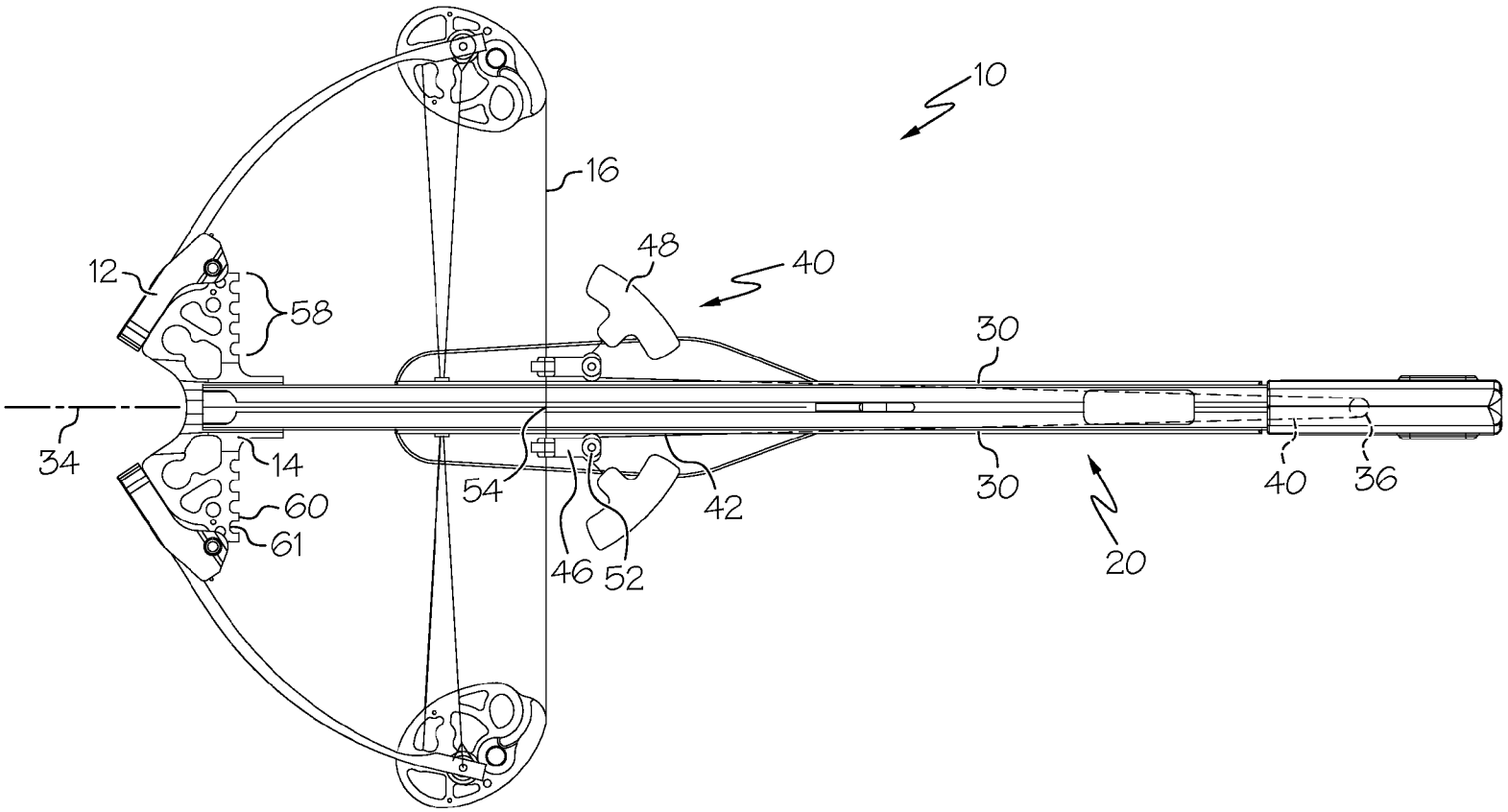
FIG. 2 shows a top view of an embodiment of a crossbow and a rope cocking device.

FIGS. 1 and 2 each show an embodiment of a crossbow 10 and an embodiment of a crossbow cocking device 40. The crossbow 10 is oriented in an undrawn (e.g. rest or brace) condition. Desirably a crossbow 10 comprises a bow portion 12 attached to a stock portion 20. The bow portion 12 can be any suitable bow configuration, such as a compound bow or a recurve bow. Desirably, the bow portion 12 comprises a bowstring 16 that can be drawn in a rearward direction, storing energy in the bow portion 12. When the bowstring 16 is released, an arrow or bolt can be fired.

Desirably, the stock portion 20 comprises a latch 22 configured to retain the bowstring 16 in a cocked orientation, and a trigger 24 arranged to release the latch 22. Desirably, the crossbow 10 defines a shooting axis 34, along which an arrow or bolt (not shown) will traverse when fired.

Desirably, the bowstring 16 includes a nocking point 54. The nock of a bolt may be engaged to the nocking point 54 prior to being fired. The nocking point 54 traverses along the shooting axis 34 as the crossbow 10 is drawn and released.

In some embodiments, the crossbow 10 comprises a step portion 58 constructed and arranged to be stepped upon while the crossbow 10 is being drawn. In some embodiments, the crossbow 10 comprises first and second step portions 58 located on opposite sides of the shooting axis 34. In some embodiments, a prod 14 attaches the bow portion 12 to the stock portion 20. In some embodiments, the prod 14 comprises step portions 58. In some embodiments, a step portion 58 comprises a plurality of surfaces 60 arranged on a common plane, with gaps 61 therebetween. In some embodiments, a crossbow 10 comprises step portions as described in U.S. Provisional Patent Application No. 61/699,197, the entire disclosures of which are hereby incorporated herein by reference.

Desirably, the crossbow 10 comprises an anchor 36 that is suitable to serve as an anchor for a crossbow cocking device 40, such as a cocking rope. In some embodiments, an anchor 36 is attached to an underside of the stock. In some embodiments, a first side (e.g. top) of the stock 20 defines the shooting axis 34, and the anchor 36 is attached to a second side (e.g. bottom), wherein the second side is opposite the first side.

In some embodiments, a cocking device 40 comprises a rope 42, string or other suitable flexible tensile member. In some embodiments, a cocking device 40 comprises hook assemblies 46 arranged to engage the bowstring 16. In some embodiments, a cocking device 40 comprises handles 48, which can be located at opposed ends of the cocking device 40.

Figure 3:
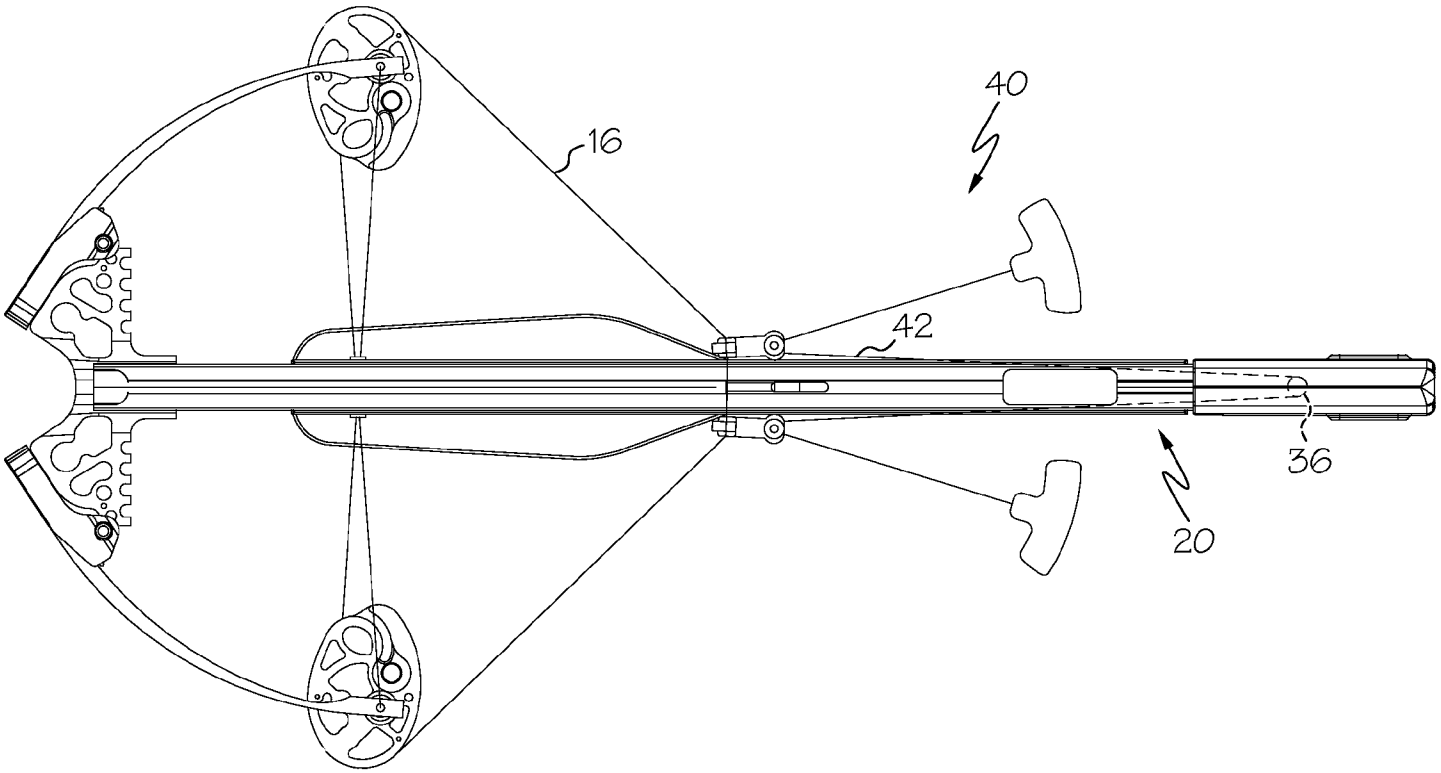
FIG. 3 shows a top view of an embodiment of a crossbow and a rope cocking device during a cocking operation.
Figure 4:
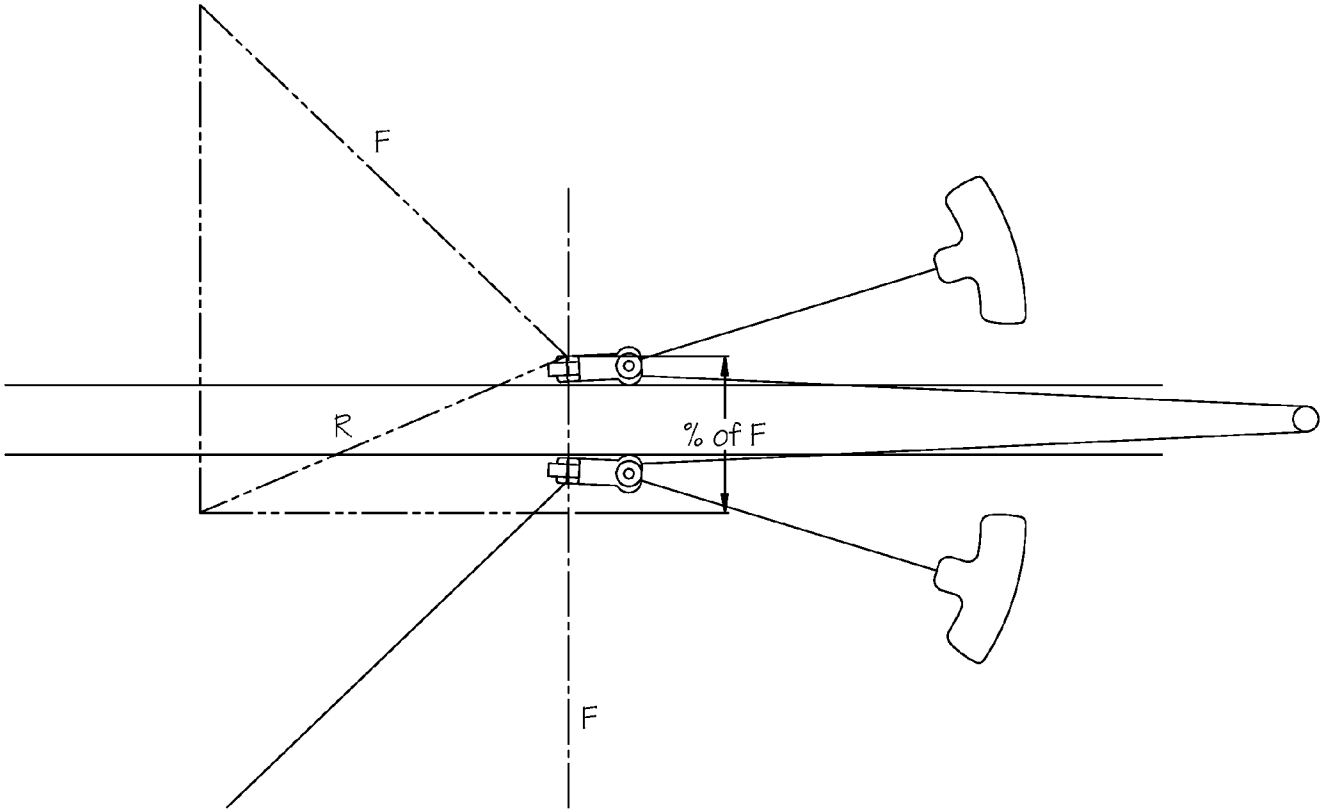
FIG. 4 shows forces acting upon the rope cocking device when oriented as shown in FIG. 3.
Figure 5:
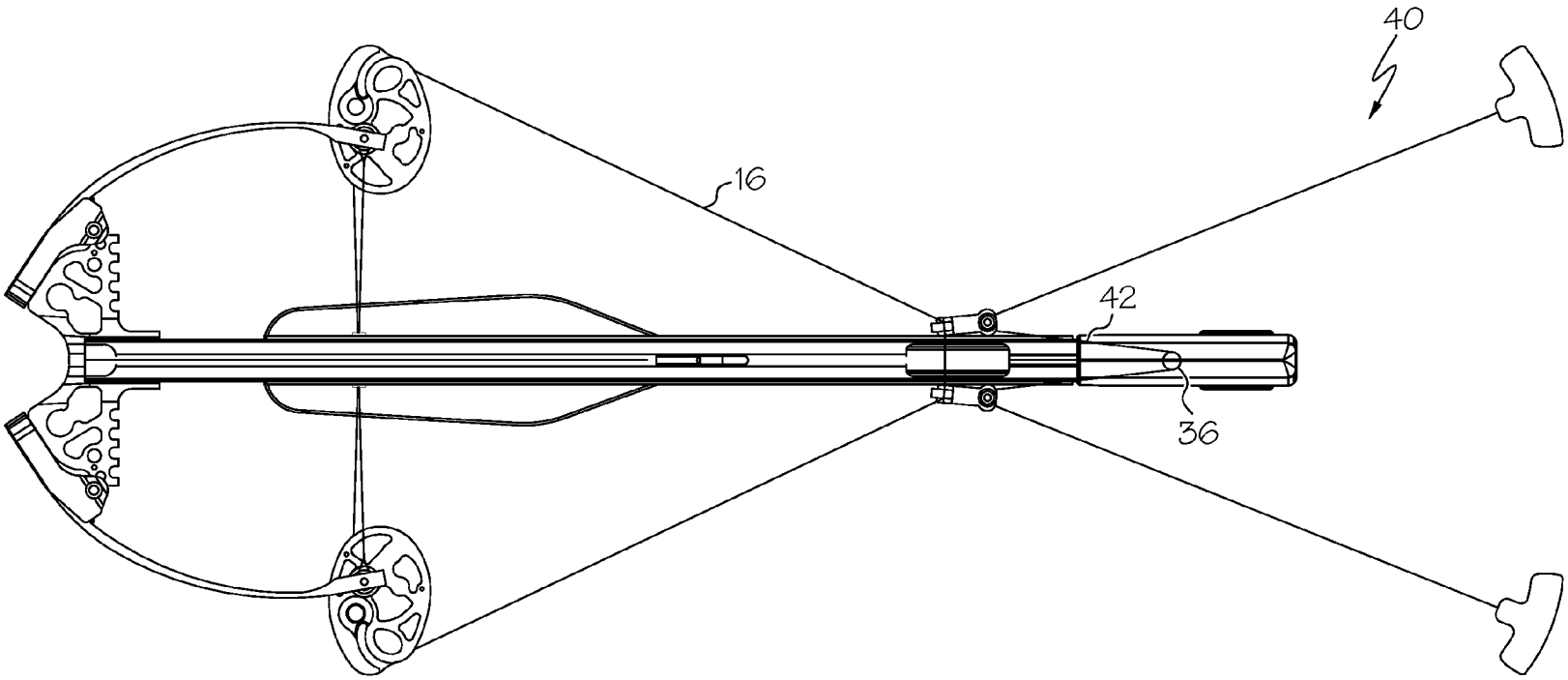
FIG. 5 shows a top view of an embodiment of a crossbow and a rope cocking device at the end of a cocking operation
Figure 6:
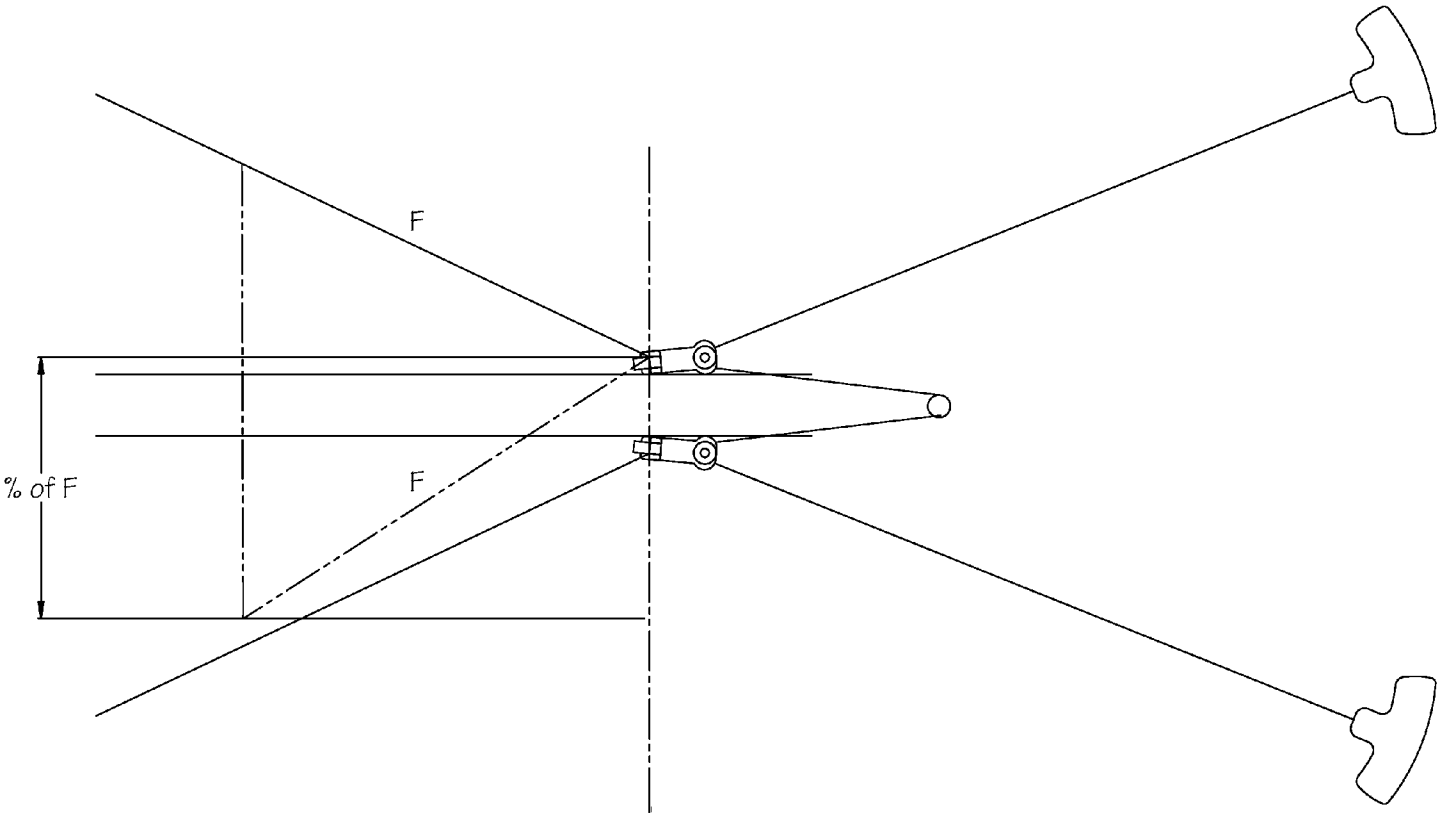
FIG. 6 shows forces acting upon the rope cocking device when oriented as shown in FIG. 5.

A configuration of the cocking device 40 is better viewed in FIG. 2. In some embodiments, the rope 42 can be trained around the anchor 36 and extend forward toward the bowstring 16. Each hook assembly 46 is hooked to the bowstring 16, and each end of the rope 42 extends rearward. The handles 48 are often T-shaped and provide a structure that is easily grasped by an archer. As the ends of the cocking device 40 are pulled rearward (e.g. away from the bow portion 12), the cocking device 40 provides leveraging that eases the cocking operation. FIGS. 3 and 5 show the crossbow 10 at later stages of a cocking operation.

Referring again to FIG. 1, desirably, the anchor 36 comprises a groove 37 and/or a protrusion 38 arranged to retain the cocking device 40 in the anchor 36. In some embodiment, a groove 37 comprises an arcuate cross-sectional shape, for example having curvature about a horizontal axis. In some embodiments, the groove 37 extends in an arcuate shape along its length. In some embodiments, the groove 37 is U-shaped along its length. As shown in FIG. 1, the groove 37 extends in an arcuate shape about a vertical axis, defining a "maximum" that faces the rear of the crossbow 10. In some embodiments, groove 37 and/or a protrusion 38 extends around an entire periphery of the anchor 36.

Desirably, the anchor 36 is located rearward of the bowstring 16. Desirably, the anchor 36 is located vertically below the shooting axis 34 defined by the crossbow 10. In some embodiments, the crossbow 10 comprises a trigger 24 located to a first side (e.g. below) of the shooting axis 34, and the anchor is also located to the first side (e.g. below) of the shooting axis 34. In some embodiments, a crossbow 10 comprises a sight mount 26 located to a second side (e.g. above) of the shooting axis 34.

Orienting the anchor 36 below the shooting axis 34 causes a portion of the cocking rope 42 extending between the anchor 36 and the bowstring 16/hook assembly 46 to be oriented at an angle $\alpha$ to the shooting axis 34. Similarly, a reference line extending between the anchor 36 and the nocking point 54 will form the angle $\alpha$ with the shooting axis 34 in the brace condition. As shown in FIG. 1, the angle $\alpha$ is approximately 6 degrees. This allows the ends/handles 48 of the cocking device 40 to be pulled at certain pull angles $\beta$ above the shooting axis 34 without causing the bowstring 16 to lift above the shooting axis 34. In some embodiments, the pull angle $\beta$ can be any angle up to and including the angle $\alpha$ without applying any vertical force to the bowstring 16.

In various embodiments, the angle $\alpha$ can be any suitable value greater than zero. Desirably, the angle $\alpha$ is at least 2 degrees. In some embodiments, the angle $\alpha$ is at least 4 degrees. In some embodiments, the angle $\alpha$ is at least 6 degrees. In some embodiments, the angle $\alpha$ is at least 10 degrees.

An anchor 36 can be provided at any suitable location on the crossbow 10. Desirably, an anchor 36 provides enough strength to resist the draw weight of the crossbow 10.

Orienting an anchor such that the angle $\alpha$ between the cocking rope 42 and the shooting axis 34 is larger allows for a larger pull angle $\beta$.

In some embodiments, multiple anchors 36 are provided on a crossbow 10, which allows a user to select the anchor 36 that is most appropriate for the pull angle $\beta$ that tends to result when the user cocks the crossbow 10. The pull angle $\beta$ tends to vary between shooters, as tall archers may lean farther over the crossbow during a cocking operation. For example, FIG. 1 shows a second anchor **36*b***, that would provide an angle $\alpha$ of approximately 12.5 degrees.

Any suitable number of anchors 36 can be provided. Desirably, the multiple anchors 36 are each oriented to form a different angle $\alpha$ with the shooting axis 34.

In some embodiments, a crossbow 10 includes a shoulder pad 64, and the shoulder pad 64 comprises an anchor 36.

In some embodiments, a second anchor **36*b* defines a second reference line extending between said second anchor 36*b* and nocking point 54, the second reference line oriented an angle $\alpha$ to the shooting axis 34. In some embodiments, the second reference line defines an angle $\alpha$ that is greater than the angle $\alpha$ provided by a first anchor 36. In some embodiments, the second reference line defines an angle $\alpha$ that is twice the angle $\alpha$ provided by a first anchor 36**, or more.

In some embodiments, a hook assembly 46 comprises a roller 52, which acts as a pulley as the rope 42 is drawn.

In some embodiments, either the crossbow 10, the cocking device 40, or both, are configured to engage one another as portions of the cocking device 40 slide along the crossbow 10. For example, in some embodiments, the stock portion 20 comprises one or more rails 30 that extend along the length of the crossbow 10. Each hook assembly 46 can engage a rail 30, and the engagement helps to keep the hook assemblies moving parallel to the shooting axis 34. In some embodiments, a rail 30 comprises a cross-section having a mating shape, and the hook assembly 46 comprises a complimentary mating shape. For example, a rail 30 can comprise a protrusion and a hook assembly can comprise a groove, or vice versa.

As shown in FIGS. 3-6, as the hook assemblies 46 are pulled in the rearward direction, forces applied by the bowstring 16 bias each hook assembly 46 toward one another (toward the shooting axis 43). These inward forces provide stability during the cocking operation and help to assure that the hook assemblies 46 remain engaged with the stock portion 20.

Figure 7:
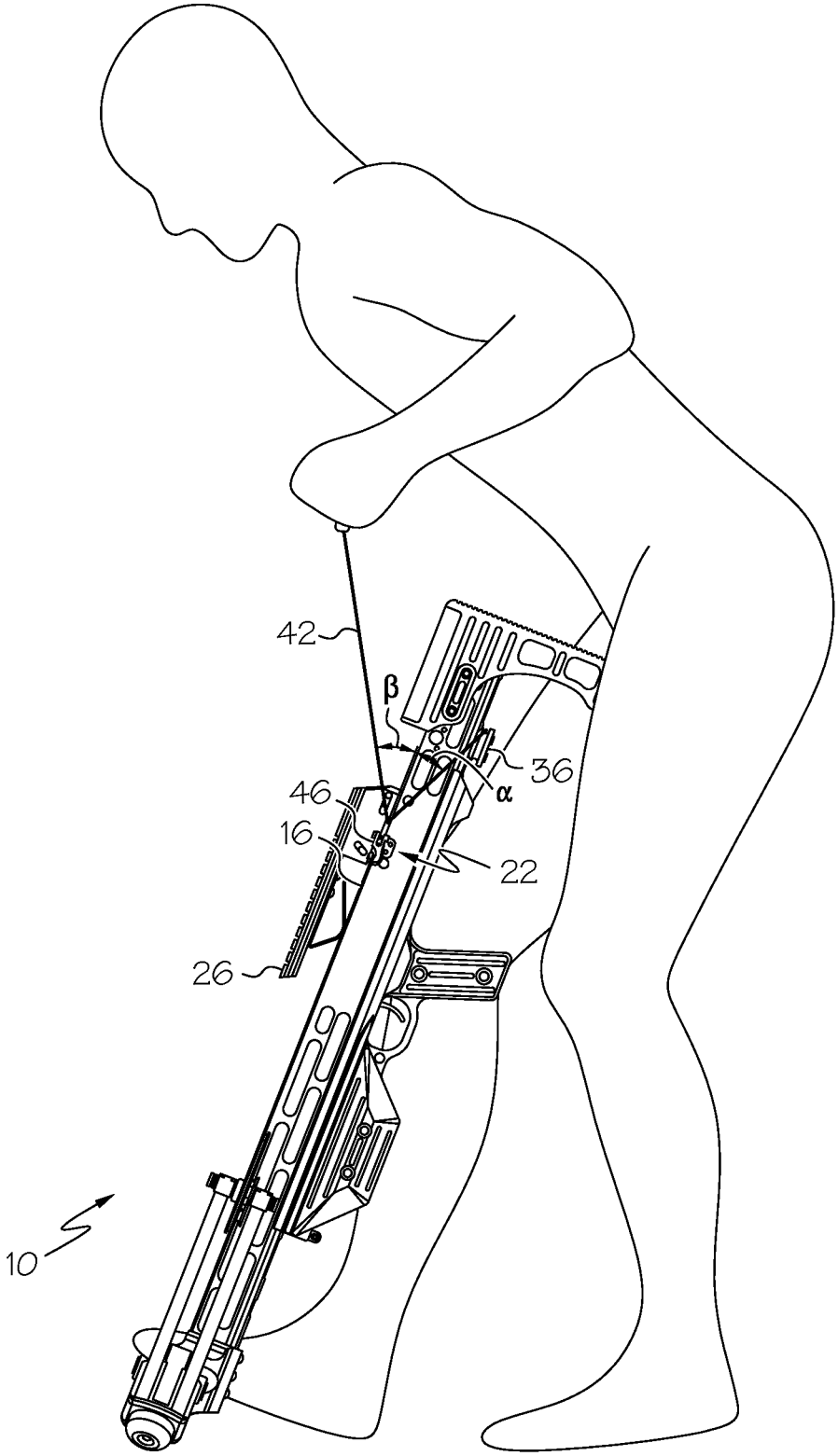
FIG. 7 shows a side view of an embodiment of a crossbow in a drawn condition, and a rope cocking device.

FIG. 7 shows a side view of a crossbow 10 similar to the view of FIG. 1, but the crossbow 10 is being drawn by an archer. The archer's feet can be placed upon tread portions of the crossbow 10. Typically the archer will lean over the crossbow 10 as the bowstring 16 is being drawn. FIG. 7 shows how a cocking rope 42 can extend as it is being pulled by the archer, and how placement of the anchor 36 below the shooting axis works to balance forces and add stability during draw.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow system comprising:

a crossbow comprising a stock and a bow portion, said bow portion comprising a bowstring having a nocking point, said crossbow defining a shooting axis, said stock comprising a butt end, said stock comprising a rope anchor located below said shooting axis and forward of said butt end, said rope anchor comprising a groove that surrounds an entire periphery of said rope anchor; and a cocking rope constructed and arranged to engage said bowstring and to be anchored to said rope anchor, said cocking rope extending continuously between a first end and a second end, said cocking rope comprising a first handle located at the first end and a second handle located at the second end.

2. The crossbow system of claim 1, wherein said rope anchor is fixedly attached to a bottom surface of said stock.

3. The crossbow system of claim 1, wherein a reference line extending between said rope anchor and said nocking point in a rest condition of said crossbow forms an angle with said shooting axis of at least 4 degrees.

4. The crossbow system of claim 3, wherein said angle is approximately 6 degrees.

5. The crossbow system of claim 3, wherein said angle is at least 10 degrees.

6. The crossbow system of claim 1, wherein said groove faces a rearward direction of said crossbow.

7. The crossbow system of claim 1, wherein said groove comprises a U-shape.

8. The crossbow system of claim 1, wherein said crossbow comprises a step portion arranged to be stepped upon during crossbow cocking.

9. The crossbow system of claim 8, wherein said crossbow comprises a prod comprising a treaded surface.

10. The crossbow system of claim 1, wherein said cocking rope comprises at least one hook arranged to engage said bowstring.

11. The crossbow system of claim 10, wherein said hook comprises a roller.

12. The crossbow system of claim 1, wherein a length portion of said groove extends in an arcuate shape about an axis oriented orthogonal to said shooting axis.

13. A crossbow system comprising:

a crossbow comprising a stock and a bow portion, said bow portion comprising a bowstring having a nocking point, said crossbow defining a shooting axis, said stock comprising a butt end, said stock comprising a first rope anchor located below said shooting axis and forward of said butt end, said first rope anchor comprising a groove that surrounds an entire periphery of said rope anchor, said stock comprising a second rope anchor; and a cocking rope constructed and arranged to engage said bowstring, said cocking rope extending continuously between a first end and a second end, said cocking rope comprising a first handle located at the first end and a second handle located at the second end, said cocking rope arranged to be anchored to said first rope anchor and alternatively to said second rope anchor.

14. The crossbow system of claim 13, wherein a first reference line extending between said first rope anchor and said nocking point in a rest condition of said crossbow forms a first angle with said shooting axis of at least 4 degrees, and a second reference line extending between said second rope anchor and said nocking point in a rest condition of said crossbow forms a second angle with said shooting axis, said second angle being greater than said first angle.

15. The crossbow system of claim 14, wherein said second angle is at least 8 degrees.

16. The crossbow system of claim 13, wherein said cocking rope comprises a first handle located at a first end of said cocking rope and a second handle located at a second end of said cocking rope.

17. The crossbow system of claim 13, said second rope anchor located on said butt end.

18. A crossbow comprising:

a stock and a bow portion, said bow portion comprising a bowstring having a nocking point, said crossbow defining a shooting axis, said stock comprising a first side surface, a second side surface, a bottom surface and a butt end, said stock comprising a rope anchor located below said shooting axis and forward of said butt end, said rope anchor comprising a groove that extends around an entire periphery of said rope anchor, said rope anchor contacting said bottom surface of said stock.

19. The crossbow of claim 18, wherein a length portion of said groove extends in an arcuate shape about an axis oriented orthogonal to said shooting axis.

* * * * *